United States Patent [19]

McGuckin

[11] 4,022,617

[45] May 10, 1977

[54] PHOTOTHERMOGRAPHIC ELEMENT, COMPOSITION AND PROCESS FOR PRODUCING A COLOR IMAGE FROM LEUCO DYE

[75] Inventor: Hugh G. McGuckin, Rochester, N.Y.

[73] Assignee: Eastman Kodak Company, Rochester, N.Y.

[22] Filed: Jan. 19, 1976

[21] Appl. No.: 650,099

Related U.S. Application Data

[63] Continuation-in-part of Ser. No. 491,713, July 25, 1974, abandoned.

[52] U.S. Cl. ..... 96/29 D; 96/54; 96/55; 96/77; 96/100; 96/114.1

[51] Int. Cl.[2] ..... G03C 5/54; G03C 7/00; G03C 1/40; G03C 1/02

[58] Field of Search ..... 96/114.1, 77, 29 D, 96/54, 55, 100, 66 T

[56] References Cited

UNITED STATES PATENTS

| | | | |
|---|---|---|---|
| 3,180,731 | 4/1965 | Roman et al. | 96/114.1 |
| 3,245,789 | 4/1966 | Rogers | 96/29 D |
| 3,383,212 | 5/1968 | MacLachlan | 96/114.1 |
| 3,409,457 | 11/1968 | Menzel | 427/150 |
| 3,531,286 | 9/1970 | Renfrew | 96/114.1 |
| 3,592,650 | 7/1971 | De Selms | 96/48 R |
| 3,761,270 | 9/1973 | de Mauriac et al. | 96/114.1 |
| 3,764,328 | 10/1973 | Birkeland | 96/114.1 |
| 3,785,830 | 1/1974 | Sullivan et al. | 96/114.1 |
| 3,801,321 | 4/1974 | Evans et al. | 96/114.1 |
| 3,985,565 | 10/1976 | Gabrielsen et al. | 96/114.1 |

OTHER PUBLICATIONS

"Photothermographic Element . . . Image", Gabrielsen et al., *Research Disclosure* No. 14347 Mar., 1976, pp. 32–35.

"Photothermographic Element . . . Image", McGuckin, *Research Disclosure* No. 13443 June, 1975, pp. 41–44.

Allen; R. L. M., *Color Chemistry* Appleton–Century–Crafts, New York c. 1971, pp. 103–117.

*Primary Examiner*—David Klein
*Assistant Examiner*—Richard L. Schilling
*Attorney, Agent, or Firm*—J. J. Ruch

[57] ABSTRACT

A photothermographic element and composition for providing a dye image comprises (a) photographic silver halide in association with (b) an oxidation-reduction image-forming combination comprising (i) a silver salt oxidizing agent, with (ii) an organic reducing agent, (c) a polymeric binder for the element or composition and (d) a leuco-base dye which is oxidizable to form a dye image. After imagewise exposure of a photothermographic element or composition containing the described combination, a color image can be developed by overall heating the photothermographic element. Negative or positive dye images can be provided. The dye image can be transferred to an image receiver.

36 Claims, No Drawings

PHOTOTHERMOGRAPHIC ELEMENT, COMPOSITION AND PROCESS FOR PRODUCING A COLOR IMAGE FROM LEUCO DYE

This application is a continuation-in-part application of U.S. Ser. no. 491,713, filed July 25, 1974 and now abandoned.

BACKGROUND OF THE INVENTION

1. Field of the Invention

This invention relates to photothermographic elements, compositions and processes for providing a developed image in color by heating the element or composition after imagewise exposure. In one of its aspects, it relates to a photothermographic element for providing such a developed image in color containing certain leuco-base dyes in association with (a) photographic silver halide with (b) an oxidation reduction image-forming combination comprising (i) a silver salt oxidizing agent, with (ii) an organic reducing agent. In another of its aspects, it relates to a photothermographic composition containing the described components. A further aspect relates to a diffusion transfer photothermographic element containing the described combination of components with an image-receiving layer. A further aspect relates to a process of developing an image in color in an imagewise exposed photothermographic element as described by heating the element.

2. Description of the State of the Art

It is well known to develop a latent image in a photothermographic element by so-called processing with heat. After imagewise exposure, the resulting latent image in the photothermographic element is developed by heating the photothermographic element. Such photothermographic elements and processes are described, for example, in U.S. Pat. No. 3,152,904 of Sorensen et al, issued Oct. 13, 1964; U.S. Pat. No. 3,301,678 of Humphlett et al, issued Jan. 31, 1967; U.S. Pat. No. 3,392,020 of Yutzy et al, issued July 9, 1968; U.S. Pat. No. 3,457,075 of Morgan et al issued July 22, 1969; British Pat. No. 1,131,108, published Oct. 23, 1968; German Pat. No. 888,045, issued June 29, 1943 and British Pat. No. 1,161,777 published Aug. 20, 1969.

Certain photographic materials for producing a developed image in color by so-called processing with heat are described, for example, in U.S. Pat. No. 3,531,286 of Renfrew, issued Sept. 29, 1970. Other photothermographic materials for producing an image in color by heating a photothermographic element are described in U.S. Pat. No. 3,761,270 of deMauriac et al, issued Sept. 25, 1973. The photothermographic materials described in these patents employ color-forming couplers which react with oxidized reducing agents to provide a dye image. It has been desirable to avoid the use of color-forming couplers in photothermographic materials because the color-forming couplers have been thought to require a relatively high pH, e.g. 8–13, to provide a desired coupling reaction. It has also been desirable to avoid base-release agents which have been used to provide the desired pH for the coupling reaction in these photothermographic materials. However, no suitable solution for eliminating the need for color-forming couplers and base-release agents in photothermographic materials of the described type is evident from the art. Also, in some cases, employing color-forming couplers with para-phenylenediamine developing agents in photothermographic materials to form color images provides undesired spontaneous reduction of, for example, silver behenate, in the presence of the color-developing agent.

Other photothermographic materials are known. These can comprise certain dyes and are illustrated by those materials described in U.S. Pat. No. 3,007,795 of Haydn et al, issued Nov. 7, 1961; U.S. Pat. No. 3,346,382 of VonKonig et al, issued Oct. 10, 1967; U.S. Pat. No. 3,383,212 of MacLochlan, issued May 14, 1968; U.S. Pat. No. 3,390,995 of Manos, issued July 2, 1968; German OLS No. 2,117,053 of Agfa-Gevaert, issued Nov. 4, 1971 and U.S. Pat. No. 3,180,731 of Roman et al, issued Apr. 27, 1965. These photothermographic materials have not provided answers to the problem of producing a photothermographic element and composition comprising photographic silver halide in association with an oxidation-reduction image-forming combination which provides a desired color image.

Thermographic materials are also known in which an image is produced by imagewise heating the material, rather than imagewise exposing the material to light followed by overall heating the material. These thermographic materials lack the photographic capability of photothermographic materials containing photographic silver halide. Typical thermographic materials are described, for example, in U.S. Pat. No. 3,409,457 of Menzel, issued Nov. 5, 1968; U.S. Pat. No. 3,447,944 of Werner, issued June 3, 1969; and U.S. Pat. No. 3,663,258 of Wiese et al, issued May 16, 1972.

There has been a continuing need to provide photothermographic elements, compositions and processes for producing a color image wherein the photothermographic element or composition comprisess photographic silver halide in association with a so-called oxidation-reduction image-forming combination and a development modifier without the need of a color-forming coupler and a base-release agent.

SUMMARY OF THE INVENTION

It has been found according to this invention that a photothermographic element or composition for producing a dye image without the need of a color-forming coupler or a base-release agent comprises a. photographic silver salt, such as photographic silver halide, in association with
b. an oxidation-reduction image-forming combination comprising
   i. a non-light sensitive, organic, silver salt oxidizing agent, with
   ii. an organic reducing agent,
c. a polymeric binder for the materials, and
d. a leuco base dye which is oxidizable to form a dye image.

After imagewise exposure of a photothermographic element or composition containing the described combination, a color image can be developed by heating the photothermographic element or composition. With certain silver salt oxidizing agents, such as a silver salt of a thione compound as described herein, in a photothermographic element or composition of the invention a development modifier, also as described herein is useful to provide a desired developed image.

It has also been found according to the invention that a dye image can be provided in a diffusion transfer, photothermographic element comprising a support having thereon, in sequence, I. a layer comprising
  a. photographic silver salt, such as photographic silver halide in association with
  b. an oxidation-reduction image-forming combination, as described,
  c. a polymeric binder for the layer (I), and
  d. a leuco base dye, also as described, and II. an image-receiving layer for the dye image.

A development modifier, as described herein, is useful in this embodiment of the invention. The diffusion transfer, photothermographic element can be an integral diffusion transfer photothermographic material in which an opacifying layer is present between the described layer (I) and an image-receiving layer (II).

DETAILED DESCRIPTION OF THE INVENTION

A variety of leuco base dyes which have the described property can be employed according to the invention in the described photothermographic elements and compositions. The exact mechanism by which the dye image is produced is not fully understood. It is believed that the leuco base dye, which is in its colorless form in the described combination before imagewise exposure and heating, is changed to the color form to provide the desired dye image. Accordingly, the term "leuco" as employed herein is intended to mean colorless. It is believed that, upon imagewise exposure of the described combination, the organic reducing agent and silver salt oxidizing agent react in an oxidation-reduction image-forming manner. This oxidation-reduction image-forming reaction is believed to be catalyzed by latent image silver from the photographic silver salt, such as from the photographic silver halide, upon imagewise exposure of the silver salt followed by heating of the element. When this reaction occurs, it is believed that the organic reducing agent is converted to the oxidized form. This oxidized form of the organic reducing agent is believed to react with the leuco base dye in a cross-oxidation reaction to form a dye image which can be observed in the photothermographic element or composition. The resulting dye image is in a form which can be transferred to a suitable image receiver, if desired.

Various tests can be used for determining a useful leuco base dye in a photothermographic element or composition, according to the invention. One test is described in following Example 22. In this test, a leuco base dye is substituted for the described leuco base dye of the example. If a dye image is produced in the described photothermographic element upon imagewise exposure and overall heating, the leuco base dye is considered to be acceptable Methods known in the art can be employed for preparing leuco base dyes which are useful in photothermographic elements and compositions of the invention. Typical methods of preparation and leuco base dyes are described, for example, in "Color Chemistry" by R.L.M. Allen, Meredith Corporation, New York, N.Y. 1971, pages 103–117. Typical leuco base dyes useful according to the invention are derived from triphenylmethane, its homologs and derivatives. On oxidation, triphenylmethane yields triphenylmethanol and the leuco base dyes from these compounds are salts of amino derivatives of compounds of this type. The amino groups are in different rings in the para-positions with respect to the methane carbon atom. A series of free bases is obtained by treating a triphenylmethane dye with alkali and, on reduction, the desired leuco base is formed. This is illustrated by the reduction of Pararosaniline to form the corresponding base which upon oxidation forms the desired colorless compound. Another example of a useful leuco base dye is Malachite Green which is obtained by refluxing benzaldehyde with a slight excess of dimethylaniline in the presence of a deficiency of hydrochloric or sulfuric acid. When condensation is complete, the mixture is made alkaline. Excess dimethylaniline is removed by steam distillation, the resulting leuco base, i.e. 4,4′-bis(dimethylamino)-triphenylmethane is oxidized with lead peroxide to the carbinol base, i.e. 4,4′-bis(dimethylamino)-triphenylmethanol, and after removal of lead, this is converted into the hydrochloride.

The leuco base dyes can be present in the form of their salts. For example, Malachite Green can be present as a zinc chloride double salt or as a hydrochloride, sulphate or oxalate.

A useful class of leuco base dyes according to the invention is a leuco base triphenylmethane dye represented by the formula:

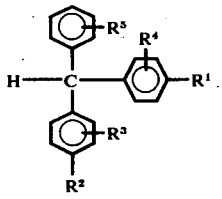

(I)

wherein $R^1$ and $R^2$ are each or amino, i.e.,

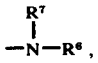

$R^3$, $R^4$ $R^5$ are each amino, hydrogen, alkyl containing 1 to 6 carbon atoms, such as methyl, ethyl, propyl and butyl, or alkoxy containing 1 to 3 carbon atoms, such as methoxy and ethoxy, $R^6$ and $R^7$ are each alkyl containing 1 to 5 carbon atoms, such as methyl, ethyl or proply; hydroxyalkyl containing 1 to 5 carbon atoms, such as hydroxymethyl, hydroxyethyl or hydroxybutyl; or aryl containing 6 to 12 carbon atoms, such as phenyl or naphthyl.

Examples of leuco base dyes according to the invention are:

Malachite Green
Crystal Violet
Pararosaniline

Other useful leuco dyes which can be employed in the photothermographic elements and compositions of the invention are described, for example, in U.S. Pat. No. 3,630,736 of Cescon, issued May 19, 1969; U.S. Pat. No. 3,445,234 of Cescon et al, issued May 20, 1969; U.S. Pat. No. 3,409,457 of Menzel, issued Nov. 5, 1968; U.S. Pat. No. 3,180,731 of Roman et al, issued Apr. 27, 1965 and U.S. Pat. No. 3,447,944 of Werner, issued June 3, 1969.

One embodiment of the invention comprises a photothermographic element for producing a dye image comprising a support having coated thereon a. photographic silver salt, as described, in association with b. an oxidation-reduction image-forming combination comprising
   i. a silver salt oxidizing agent, as described with
   ii. an organic reducing agent,
c. a polymeric binder, and
d. a leuco base dye, said dye having the property of cross-oxidizing with the oxidized form of said organic reducing agent to form said dye image upon imagewise exposure and overall heating of said element. With certain silver salt oxidizing agents, such as a silver salt of a thione compound as described herein, in this embodiment a development modifier, as described herein, is useful to provide a desired developed image.

The described photothermographic elements and compositions, according to the invention, contain photographic silver salt, such as photographic silver halide. In the described photothermographic materials, it is believed that latent image silver from the photothermographic combination acts as a catalyst for the described oxidation-reduction image-forming combination. A typical concentration of photographic silver salt, such as photographic silver halide, in the described photothermographic elements and compositions is from about 0.005 mole to about 0.50 mole of photographic silver salt per mole of described silver salt oxidizing agent. Examples of useful photographic silver halides are silver chloride, silver bromide, silver chlorobromide, silver bromoiodide, silver chloroiodide, silver chlorobromoidide, or mixtures thererof. For purposes of the invention, silver iodide is also considered a photographic silver halide. The photographic silver halide is typically present with the other components of the described photothermographic element and composition in the form of a dispersion in a suitable polymeric binder. The photograhic silver halide can be coarse or fine-grained, very fine-grained silver halide being especially useful. The silver halide dispersion containing the photographic silver halide can be prepared by any of the well-known procedures in the photographic art for preparing photographic silver halide emulsions, such as single-jet emulsions, double-jet emulsions, such as Lippmann emulsions, ammoniacal emulsions, thiocyanate or thioether-ripened emulsions such as those described in U.S. Pat. No. 2,222,264 of Nietz et al, issued Nov. 14, 1940; U.S. Pat. No. 3,320,069 of Illingsworth, issued May 15, 1967 and U.S. Pat. No. 3,271,157 of McBride, issued Sept. 6, 1966. Surface image silver halide materials can be used. If desired, mixtures of surface and internal image silver halide materials can be used, as described in U.S. Pat. No. 2,996,332 of Luckey et al, issued Apr. 15, 1961. Negative-type silver halide compositions can be used. The silver halide can be a regular grain silver halide such as described in Klein and Moisar, *Journal of Photographic Science*, Vol. 12, No. 5, Sept.-Oct., (1964), pages 242-251.

The silver halide employed according to the invention can be unwashed or washed to remove soluble salts. In the latter case, the soluble salt can be removed by chill setting and leaching or the composition containing the silver halide can be coagulation washed.

The silver halide employed according to the invention can be sensitized with chemical sensitizers such as with reducing agents; sulfur, selenium or tellurium compounds, gold, platinum or palladium compounds; or combinations of these. Suitable procedures for chemical sensitization are described, for example, in U.S. Pat. No. 1,623,499 of Sheppard, issued Apr. 5, 1972; U.S. Pat. No. 2,399,083 of Waller et al, issued Apr. 23, 1946; U.S. Pat. No. 3,297,447 of McVeigh, issued Jan. 10, 1967 and U.S. Pat. No. 3,297,446 of Dunn, issued Jan. 10, 1967.

The photographic silver halide, according to the invention, can be protected against the production of fog and can be stabilized against the loss of sensitivity during keeping. Suitable antifoggants and stabilizers which can be used alone or in combination include, for example, thiazolium salts; azaindenes; mercury salts as described, for example, in U.S. Pat. No. 2,728,663 of Allen et al, issued Dec. 27, 1955; urazoles; sulfocatechols; oximes described, for example, in British Pat. No. 623,448; nitron; nitroindazoles; polyvalent metal salts described, for example, in U.S. Pat. No. 2,839,405 of Jones, issued June 17, 1958; platinum, palladium and gold salts described, for example in U.S. Pat. No. 2,566,263 of Trevelli et al, issued Aug. 28, 1951 and U.S. Pat. No. 2,597,915 of Yutzy et al, issued May 27, 1952.

If desired, the photographic silver halide can be prepared in situ in the photothermographic elements and compositions according to the invention. The photographic silver halide is accordingly prepared in or on one or more of the other components of the described photothermographic element or composition rather than prepared separate from the described components and then admixed with them. Such a method is described, for example, in U.S. Pat. No. 3,457,075 of Morgan et al, issued July 22, 1969. For example, a source of halide ions can be mixed with one or more of the components of the photothermographic material prior to coating the photothermograhic composition on a suitable substrate. It is necessary to have sufficient silver ion available to react with the source of halide ions in this method.

The photographic silver halide can be prepared on the silver-salt oxidizing agent, such as on the silver behenate, prior to application of the photographic silver halide on the support. This method is also described in U.S. Pat. No. 3,457,075 of Morgan et al, issued July 22, 1969.

The described silver-salt oxidizing agent and the described organic-reducing agent are believed to form an image-forming combination which is designated herein as an oxidation-reduction image-forming combination. The oxidation-reduction reaction resulting from this combination is believed to be catalyzed by the described latent image silver upon imagewise exposure and overall heating of the photothermographic element or composition of the invention.

A variety of silver-salt oxidizing agents can be employed in the photothermographic elements or compositions according to the invention. An especially useful class of silver salt oxidizing agents is the class of silver salts of long-chain fatty acids which are resistant to darkening upon exposure to light. Useful silver salt oxidizing agents include, for example, silver behenate, silver stearate, silver oleate, silver laurate, silver hydroxystearate, silver caprate, silver myristate and silver palimitate. Silver salts can be employed which are not silver salts of long-chain fatty acids include, for example, silver benzoate, silver benzoatriazole, silver terephthalate, silver phthalate, and the like.

Another useful class of silver salt oxidizing agents is a silver salt of a thione compound represented by the formula:

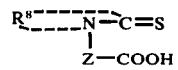

(II)

wherein $R^8$ represents atoms completing a 5 member heterocyclic nucleus and Z is alkylene containing 1 to 14 carbon atoms. Examples of useful 5 member heterocyclic nuclei for the described thione compounds are thiazoline-2-thione, benzothiazoline-2-thione, imidazoline thione or similar heterocyclic thione nuclei. The 5 member heterocyclic nuclei can contain substituent groups which do not adversely affect the described photothermographic elements or compositions, such as alkyl containing 1 to 3 carbon atoms or phenyl. Alkylene as described for Z includes so-called branch-chain alkylene groups such as $>CH\text{-}CH_3$. Examples of silver salt oxidizing agents within the described class include the silver salts of the following:

3-(2-carboxyethyl)-4-methyl-4-thiazoline-2-thione,
3-(2-carboxyethyl)benzoathiazoline-2-thione,
3-(2-carboxyethyl)-5-phenyl-1,3,4-oxadiazoline-2-thione,
3-(2-carboxyethyl)-5-phenyl-1,3,4-thiadiazoline-2-thione,
3-carboxymethyl-4-methyl-4-thiazoline-2-thione,
3-(2-carboxyethyl)-1-phenyl-1,3,4-triazoline-2-thione, 1,3-bis(2-carboxyethyl)imidazoline-2-thione,
1,3-bis(2-carboxyethyl)benzimidazoline-2-thione,
3-(2-carboxyethyl)-1-methylimidazoline 2-thione,
3-(2-carboxyethyl)benzoxazoline-2-thione, and
3-(1-carboxyethyl)-4-methyl-4-thiazoline-2-thione, such as described in U.S. Pat. No. 3,785,830 of Sullivan et al, issued Jan. 15, 1974.

If desired, combinations of silver salt oxidizing agents can be employed in the described photothermographic elements and compositions.

A variety of organic reducing agents can be employed in the photothermographic elements and compositions according to the invention. These are typically silver halide developing agents and include, for example, polyhydroxybenzenes such as hydroquinone, alkyl-substituted hydroquinones, as exemplified by tertiary butyl hydroquinone, methyl hydroquinone, 2,5-dimethyl hydroquinone and 2,6-dimethyl hydroquinone; catechols and pyrogallol; halo-substituted hydroquinones, such as chlorohydroquinone or dichlorohydroquinone; alkoxy-substituted hydroquinones such as methoxyhydroquinone or ethoxyhydroquinone; methyl hydroxy naphthalene; phenylenediamine developing agents; methyl gallate; aminophenol developing agents, such as 2,4-diaminophenols and methyl aminophenols; ascorbic acid developing agents, such as ascorbic acid, ascorbic acid ketals and ascorbic acid derivatives; hydroxylamine developing agents, such as N,N'-di(2ethoxyethyl)hydroxylamine; 3-pyrazolidone developing agents such as 1-phenyl-3-pyrazolidone and 4-methyl-4-hydroxy methyl-1-phenyl-3-pyrazolidone, including those described in British Pat. No. 930,572 published July 3, 1963; hydroxytetronic acid and hydroxytetronimide developing agents; reductone developing agents; bis-beta naphthol reducing agents such as described in U.S. Pat. No. 3,672,904 issued June 27, 1972; sulfonamidophenol reducing agents such as described in Belgian Pat. No. 802,519 issued Jan. 18, 1974 and the like. Combinations of organic reducing agents can be employed, if desired.

In order to provide a desired dye image, a development modifier, also known as a toner, activator-toner, or toner accelerator, is useful in the described photothermographic elements and compositions of the invention. The development modifier is useful in photothermographic materials with certain silver salt oxidizing agents, such as a silver salt of a thione compound as described herein, to provide a desired developed image. As employed herein, development modifier is intended to mean a compound which improves the tone of the developed image, increases the photographic speed of the photothermographic material of the invention, or increases the development rate upon processing of the exposed photothermographic element or composition as described. An increase in development rate is intended to mean that the latent image can be developed in reduced processing time or at reduced temperature or both.

Useful development modifiers are typically heterocyclic compounds containing at least one nitrogen atom, such as cyclic imides. Useful development modifiers, for example, phthalimide, 2,3-naphthalimide, N-hydroxyphthalimide, N-hydroxy-1,8-napthalimide, N-potassium phthalimide, N-silver phthalimide, N-mercury phthalimide, succinimide and/or N-hydroxysuccinimide.

Other useful development modifiers include 1-(2H)-phthalazinone, phthalic anhydride, 2-acetylphthalazinone and 2-phthalylphthalazinone.

Combinations of development modifiers can be employed in the described photothermographic elements and compositions if desired.

A photothermographic element or composition according to the invention contains a polymeric binding agent for the various components of the element or composition. These polymeric materials can be used alone or in combination as vehicles or binding agents and in various layers. Useful polymeric materials are typically hydrophobic, but hydrophilic materials can be used if desired. The polymeric materials are transparent or translucent and include those which are derived from naturally occurring substances such as gelatin, substituted cellulose and the like; and synthetic polymeric materials. Useful synthetic polymeric materials include dispersed vinyl compounds, such as in latex form, and particularly those which increase dimensional stability of photographic materials. Useful synthetic polymeric binders include those described in U.S. Pat. No. 3,142,586 of Nottorf, issued July 28, 1964; U.S. Pat. No. 3,193,386 of White, issued July 6, 1955; U.S. Pat. No. 3,062,674 of Houck et al, issued Nov. 6, 1962; U.S. Pat. No. 3,220,844 of Houck et al, issued Nov. 30, 1965; U.S. Pat. No. 3,287,289 of Ream et al, issued Nov. 22, 1966 and U.S. Pat. No. 3,411,911 of Dykstra, issued Nov. 19, 1968. Effective polymeric materials include water insoluble polymers of alkyl acrylates and methacrylates, acrylic acid, sulfoalkyl acrylates or methacryltes and those which have cross-linking sites which facilitate hardening or curing as well as those having recurring sulfobetaine units as described in Canadian Pat. No. 774,054. Useful polymeric binders and resins include poly(vinyl butyral), cellulose acetate butyrate, polymethyl methacrylate, ethyl celluslose, polystyrene, poly(vinyl chloride), chlorinated rubber, polyisobutylene, butadiene-styrene copolymers, vinyl chloride-vinyl acetate copolymers, copolymers of vinyl acetate, vinyl chloride and maleic acid and poly(vinyl alcohol). Combinations of polymeric binders can be employed if desired.

Ranges of the various concentrations of components can be used in the described photothermographic elements and compositions of the invention. A useful concentration of each component will depend upon several factors such as the desired image, processing temperature and time, particular components of the photothermographic element, and the like. A typical concentration range of photographic silver halide, previously described is from about 0.005 mole to about 0.50 mole of silver halide per mole of silver salt oxidizing agent. A typical concentration of organic reducing agent is about 0.12 mole to about 0.50 mole of organic reducing agent per mole of silver salt oxidizing agent. A useful concentration range of leuco base dye, as described, is about 0.08 mole to about 0.14 mole of the leuco base dye per mole of organic reducing agent, typically about 0.16 mole to about 0.066 mole of leuco base dye per mole of organic reducing agent. A useful concentration of leuco base dye is about 0.002 to about 0.010 mole of leuco base dye per mole of total silver in the described photothermographic material.

A useful embodiment of the invention is a photothermograhic element for producing a dye image comprising a support having thereon (a) photographic silver halide in association with (b) an oxidation-reducing image-forming combination comprising (i) silver behenate with (ii) a sulfonamidophenol reducing agent, such as 2,6-dichloro-4-benzenesulfonamidophenol, (c) a poly(vinyl butyral) binder and (d) about 0.002 mole to about 0.010 mole of a leuco base dye as described, per mole of total silver in the described layer. A development modifier, as described herein, such as succinimide, N-hydroxyl-1,8-naphthalimide or 1-(2H)-phthalazinone, is useful in this embodiment.

Another embodiment of the invention is a photothermographic element for producing a dye image comprising a support having thereon (a) photographic silver halide in association with (b) an organic reducing agent, as described, (c) a silver salt oxidixing agent comprising a silver salt of a compound represented by the formula:

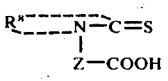

(II)

wherein $R^8$ and Z are as defined, (d) a polymeric binder, (e) a development modifier as described, and (f) a leuco base dye also as defined. Within this emodiment, useful organic reducing agents are, for example, hydroquinone silver halide developing agents such as 2,5-dichlorohydroquinone. Also, an especially useful silver salt within the described formula (II) is the silver salt of 3-carboxymethyl-4-methyl-4-thiazoline-2-thione.

Photothermographic elements according to the invention can contain antistatic or conducting layers. Such layers can comprise soluble salts such as chlorides, nitrates, and the like, evaporated metal layers, ionic polymers such as those described in U.S. Pat. No. 2,861,056 of Minsk, issued Nov. 18, 1958 and U.S. Pat. No. 3,206,312 of Sterman et al, issued Sept. 14, 1965 or insoluble inorganic salts, such as those described in U.S. Pat. No. 3,428,451 of Trevoy, issued Feb. 18, 1969.

The various layers, including the photothermographic layer or layers of a photothermographic element according to the invention, can contain light-absorbing materials, filter dyes, antihalation dyes and absorbing dyes such as those described in U.S. Pat. No. 3,253,921 of Sawdey et al, issued May 31, 1966; U.S. Pat. No. 2,274,782 of Gaspar, issued May 3, 1942; U.S. Pat. No. 2,527,583 of Silberstein et al, issued Oct. 31, 1950 and U.S. Pat. No. 2,956,879 of VanCampen, issued Oct. 18, 1960. If desired, the dyes can be mordanted, for example, as described in U.S. Pat. No. 3,282,699 of Jones et al, issued Nov. 1, 1966.

The photothermographic element and composition, according to the invention, can contain plasticizers and lubricants. Useful plasticizers and lubricants include, for example, polyalcohols such as glycerin and diols described, for example, in U.S. Pat. No. 2,960,404 of Milton et al, issued Nov. 1, 1966, fatty acids or esters such as those described in U.S. Pat. No. 2,588,765 of Robijns, issued Mar. 11, 1952; U.S. Pat. No. 3,121,060 of Duane, issued Feb. 11, 1964, and silicone resins, such as those described in British Pat. No. 955,061.

The photothermographic elements and compositions according to the invention can contain surfactants such as saponin; anionic compounds, such a alkyl-aryl sulfonates described, for example, in U.S. Pat. No. 2,600,831 of Baldsiefen, issued June 17, 1962 amphoteric compounds, such as those described in U.S. Pat. No. 3,133,816 of Ben-Ezra, issued May 19, 1964; and non-ionic surfactants such as adducts of glycidol and an alkyl phenol, described, for instance, in British Pat. No. 1,022,878.

If desired, the photothermographic elements and compositions according to the invention can contain matting agents, such as starch, titanium dioxide, zinc oxide, silica, polymeric beads, including beads described, for example, in U.S. Pat. No. 2,922,101 of Jelley et al, issued July 11, 1961 and U.S. Pat No. 2,761,245 of Lynn, issued Feb. 1, 1955.

The photothermographic elements and compositions according to the invention can contain brightening agents. Useful brightening agents include, for example, stilbenes, triazines, oxazoles and coumarin brightenig agents. Water-soluble brightening agents can be used such as those described in German Pat. No. 972,067 and U.S. Pat. No. 2,933,390 of McFall et al, issued Apr. 19, 1960. Dispersions of brighteners can be used, such as those described in German Pat. No. 1,150,274; U.S. Pat. No. 3,406,070 of Oetiker et al, issued Oct. 15, 1968 and French Pat. No. 1,530,244.

The various layers, including the photothermographic layer or layers of a photothermographic element according to the invention can be coated by various coating procedures, including dip-coating, airknife coating, curtain coating or extrusion coating using hoppers such as described in U.S. Pat. No. 2,681,294 of Beguin, issued June 15, 1954. If desired, two or more layers can be coated simultaneously such as by procedures described in U.S. Pat. No. 2,761,791 of Russell, issued Sept. 4, 1956 and British Pat. No. 837,095 published June 9, 1960.

Spectral sensitizing dyes can be used conveniently to confer additional sensitivity to the elements and compositions of the invention. For instance, additional spectral sensitization can be obtained by treating the silver halide with a solution of a sensitizing dye in an organic solvent or the dye can be added in the form of a dispersion as described in British Pat. No. 1,154,781.

For optimum results the dye can either be added to the composition as a final step or at some earlier stage.

Sensitizing dyes useful in sensitizing silver halide emulsions are described, for example, in U.S. Pat. No. 2,526,632 of Brooker et al, issued Oct. 24, 1950; U.S. Pat. No. 2,503,776 of Sprague, issued Apr. 11, 1950 of Brooker et al, issued Jan. 10, 1950 and U.S. Pat. No. 3,384,486 of Taber et al, issued May 21, 1968. Spectral sensitizers, which can be used, include the cyanines, merocyanines, complex (trinuclear or tetranuclear) cyanines. holopolar cyanines, sytryls, hemicyanines such as enamine hemicyanines, oxonols and hemioxonols.

Sensitizing dyes of the cyanine classes can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl and enamine groups that can be fused to carbocyclic or heterocyclic ring systems either unsubstituted or substituted with halogen, phenyl, alkyl, haloalkyl, cyano, or alkoxy groups. The dyes can be symmetrical or unsymmetrical and can contain alkyl, phenyl, enamine or heterocyclic substituents on the methine or polymethine chain.

Merocyanine sensitizing dyes can contain the basic nuclei described as well as acid nuclei such as thiohydantoins, rhodanines, oxazolidenediones, thiazolidenediones, barbituric acids, thiazolineones, and malononitrile. These acid nuclei can be substituted with alkyl, alkylene, phenyl carboxyalkyl, sulfoalkyl, hydroxyalkyl, alkoxyalkyl, alkylamine groups or heterocyclic nuclei. Combinations of these dyes can be used if desired. In addition, supersensitizing addenda which do not absorb visible light may be included such as, for instance, ascorbic acid derivatives, azaindenes, cadmium salts, and organic sulfonic acid as described in U.S. Pat. No. 2,933,390 of McFall et al, issued Apr. 19, 1960 and U.S. Pat No. 2,937,089 of Jones et al, issued May 17, 1960.

Another embodiment of the invention is a diffusion transfer, photothermographic element for producing a dye image comprising a support having thereon, in sequence, (I) a layer comprising (a) photographic silver salt, especially photographic silver halide, in association with (b) an oxidation-reduction image-forming combination comprising (i) a silver salt oxidizing agent, as described, with (ii) an organic reducing agent, also as described, (c) a polymeric binder for the layer (I) , and (d) a leuco base dye, as defined, and (II) an image receiving layer, preferably an image receiving layer comprising a mordant for a dye image from layer (I). A development modifier as described herein, such as succinimide, N-hydroxy-1,8-naphthalimide or 1-(2H)-phthalazinone, is useful in this embodiment, and in some cases needed to provide a desired image.

A useful diffusion transfer. photothermographic element for producing a dye image as described comprises a support having thereon (I) a layer comprising (a) photographic silver halide in association with (b) an oxidation-reduction image forming combination comprising (i) silver behenate with (ii) a sulfonamidophenol reducing agent, as described, (c) a poly(vinyl butyral) binder for the layer (I), (d) about 0.002 mole to about 0.010 mole of a leuco base dye per mole of total silver in the element wherein the leuco base dye is selected from a group consisting of Malachite Green, Crystal Violet and Pararosaniline, and (II) an image receiving layer comprising a mordant for a dye image from layer (I). A development modifier, such as succinimide, N-hydroxy-1,8-naphthalimide or 1-(2H)-phthalazinone, is useful in this embodiment.

A typical diffusion transfer, photothermographic element according to the invention is an integral diffusion transfer, photothermographic element for producing a dye image comprising a transparent support having thereon, in sequence, (I) a layer comprising (a) photographic silver salt, especially photographic silver halide, in association with (b) an oxidation-reduction image-forming combination comprising (i) a silver salt oxidizing agent, with (ii) an organic reducing agent, (c) a development modifier, as defined, (d) a polymeric binder for the layer (I), and (e) a leuco base dye, as defined herein; (II) an opacifying layer such as a titanium dioxide opacifying layer; and (III) an image receiving layer for a dye image from layer (I).

A variety of image receivers for the dye image produced according to the invention can be present in the diffusion transfer, photothermographic elements of the invention. The described image receiving layer can be a separate receiver element containing an image receiver layer on a suitable support, or the image receiving layer can be part of the photothermographic element, as described.

A variety of mordants are useful for image receiving layers according to the invention. Selection of a useful mordant will depend upon the particular dye image, processing conditions, particular compoents of the photothermographic element, desired image and the like. Useful mordants typically comprise a polymeric ammonium salt, such as those described in U.S. Pat. No. 3,709,690 of Cohen et al, issued Jan. 9, 1973.

It is desirable in some cases to employ an image stabilizer or stabilizer precursor in the described elements and compositions of the invention. These can be present in the described elements and compositions to reduce post-processing printout due to roomlight exposure and to reduce background stain in the portion of the photothermographic material containing photosensitive silver salt such as photographic silver halide. Useful stabilizer precursors include, for example, azole thioethers and blocked azoline thione stabilizer precursors, such as described in Belgian Pat. No. 768,071. Halogen containing stabilizing precursors, such as tetrabromobutane, as described in U.S. Pat. No. 3,707,377 of Tiers et al, issued Dec. 26, 1972, can be employed in the described photothermographic elements and compositions comprising photographic silver halide. The selection of a useful stabilizer or stabilizer precursor will depend upon several factors such as the desired image, the particular components of the photothermographic element or composition, processing conditions and the like. The stabilizer or stabilizer precursor, as described, is useful in a range of concentration. The stabilizer or stabilizer precursor typically is used at a concentration of about 0.002 mole to about 0.1 mole of stabilizer or stabilizer precursor per mole of silver salt oxidizing agent.

Another embodiment of the invention is a photothermographic composition comprising (a) photographic silver salt, especially photographic silver halide, in association with (b) an oxidation-reduction image-forming combustion comprising (i) a silver salt oxidizing agent, as described, with (ii) an organic reducing agent, also as described, (c) a polymeric binder for the composition, and (d) a leuco base dye as described. With certain silver salt oxidizing agents, such as a silver salt of a thione compound as described herein, in this embodiment a development modifier as described herein is useful to provide a desired developed image.

An example of a useful photothermographic composition within this embodiment is a photothermographic composition comprising (a) photographic silver halide in association with (b) an organic reducing agent, typically a hydroquinone silver halide developing agent, (c) a silver salt oxidizing agent comprising a silver salt of a compound represented by formula (II) wherein *n*, $R^8$ Z are as defined, (d) a polymeric binder for the composition, (e) a development modifier and (f) a leuco base dye as defined.

A typical photothermographic composition within this embodiment comprises (a) photographic silver halide in association with (b) a hydroquinone silver halide developing agent, (c) a silver salt of 3-carboxymethyl-4-methyl-4-thiazoline-2-thione, (d) a polymeric binder for the composition, (e) a development modifier comprising succinimide, N-hydroxy-1,8-naphthalimide or 1-(2H)-phthalazinone, and (f) a leuco base dye, as described, typically a leuco base dye selected from the group consisting of Malachite Green, Crystal Violet and Pararosaniline.

Any suitable exposure means can be used for producing a developable latent image in the described photothermographic elements or compositions of the invention. The photothermographic element, as described, is typically imagewise exposed to electromagnetic radiation sufficient to provide a developable latent image in the described elements and compositions. The latent image can be provided by imagewise exposure to, for example, ultraviolet radiation, visible light, X-ray, and electrical energy. The described photothermographic elements can be exposed with a laser if desired.

After exposure, the resulting latent image in a photothermographic element or composition, as described, can be developed by merely heating the described photothermographic element or composition. Heating is typically within a temperature range of about 80° to about 250° C.; however, a temperature range of about 100° to about 180° C. is usually suitable. By increasing or decreasing the length of time of heating, a lower or higher temperature within the described range can be employed. A developed image is typically produced within several seconds, such as within about 0.5 to about 90 seconds.

Another embodiment of the invention comprises a process of developing a dye image in an exposed photothermographic element as described herein comprising heating the element to a temperature within the range of about 80° C. to about 250° C. for a time sufficient to develop the desired image.

Processing is usually carried out under ambient conditions of pressure and humidity although pressures and humidity outside normal atmospheric conditions can be employed if desired. Normal atmospheric conditions are preferred.

Any suitable means can be used for providing the desired processing temperature range. The heating means can be a simple heated plate, iron, or roller or the like.

A useful process according to the invention comprises a process of developing an image in an exposed photothermographic element comprising a support having thereon a layer comprising (a) photographic silver salt, such as photographic silver halide, in association with (b) an oxidation-reduction image-forming combination comprising (i) silver behenate with (ii) a sulfonamidophenol reducing agent, (c) a poly(vinyl butyral) binder, and (d) about 0.002 mole to about 0.010 mole of a leuco base dye, as described, per mole of total silver in the element; said process comprising overall heating the element to a temperature within the range of about 100° to about 175° C. for about 0.5 to about 60 seconds until a dye image is formed. A development modifier, as described herein, such as succinimide, N-hydroxy-1,8-naphthalimide or 1-(2H)-phthalazinone, is useful in the described layer of the photothermographic element.

In a diffusion transfer mode, a process of the invention comprises developing an image in an exposed diffusion transfer, photothermographic element comprising a support having thereon, in sequence, (I) a layer comprising (a) photographic silver salt, especially photogaphic silver halide, in association with (b) an oxidation-reduction image-forming combination comprising (i) a silver salt oxidizing agent with (ii) an organic reducing agent, (c) a development modifier, (d) a polymeric binder for the layer and (e) a leuco base dye, as defined herein, and (II) an image receiving layer; said process comprising heating the photothermographic element to a temperature within the range of about 80° to about 250° C. until a dye image is formed and transferred into the image receiving layer. The heating time is typically within the range of about 0.5 to about 90 seconds.

After heating the described transfer photothermographic element, the receiving layer (II) can be separated from the photothermographic element. Separation of the image receiving layer can be by stripping of one of the layers or the photothermographic layer can be removed with a solvent or other suitable removing means.

The leuco base dyes of the invention can be employed for producing a dye image by contacting a photothermographic element, as defined herein, in the absence of the defined leuco base dye, during overall heating, with a dry sheet of paper or other suitable image receiver previously imbibed with a leuco base dye, as defined. A typical leuco base dye for this purpose is Malachite Green or Crystal Violet. Increased density and photographic speed are observed in this embodiment when compared to a control coating processed without the leuco base dye in the image receiver. In addition to the dye image formed in the photothermographic material, a dye image is also formed in the image receiver in the areas corresponding to the silver image in the photothermographic material. When a paper image receiver containing the described leuco base dye is in a slightly damp condition during processing, the image in the image receiver has higher dye density. Accordingly, if desired, the leuco base dye can be present in the described image receiving layer according to the invention.

The photothermographic materials according to the invention are useful for preparing postive dye images or negative dye images or both positive and negative dye images. For instance, a direct positive, dye image can be formed by, respectively, (A) providing a latent image in a photothermographic element comprising a support having thereon, a layer (I) comprising (a) photographic silver salt in association with (b) an oxidation-reduction image-forming combination comprising (i) a silver salt oxidizing agent with (ii) an organic reducing agent, (c) a development modifier, (d) a polymeric binder for the layer (I), and (e) a leuco base dye which is oxidizable to form a dye image, (B) pressing the layer (I) side of the resulting photothermographic element against the polymer layer side of a dye image receiver heating a polymer layer to provide a unit, then (C) uniformly heating the unit to provide a dye image, and thereafter, if desired, (D) separating the layers (B) and (C) from layer (A). Another example is a process of providing a direct positive, dye image in a photothermographic unit comprising, in sequence, a support having coated thereon (A) a dye image receiver layer, (B) a layer comprising a leuco base dye which is oxidizable to form a dye image, and (C) a photo-thermographic layer containing a latent image and comprising (a) photographic silver salt in association with (b) an oxidation-reduction image-forming combination comprising (i) a silver salt oxidizing agent with (ii) an organic reducing agent, (c) a development modifier and (d) a polymeric binder for layer (C), comprising heating the unit to provide a positive dye image in the image receiver layer (A), and, thereafter, if desired, separating layers (B) and (C) from layer (A). A further example is a process of providing a positive dye image in a photothermographic unit comprising, in sequence, a support having coated thereon (A) an image receiver layer, (B) a photothermographic layer containing a latent image and comprising (a) photographic silver salt in association with (b) an oxidation-reduction image-forming combination comprising (i) a silver salt oxidizing agent, with (ii) an organic reducing agent, (c) a development modifier, and (d) a polymeric binder for layer (B), and (C) a layer comprising a compound, especially a leuco base dye, which is oxidizable to form a dye image, comprising (1) heating the unit to provide a dry image in the layer (B); thereafter (2) heating the photothermographic unit, typically while exposed to ambient light conditions, such as room light, to provide a positive dye image in the layer (A). The processing conditions and components useful in the materials processed, such as the leuco base dyes, are as herein described.

The following examples are included for a further understanding of the invention.

EXAMPLE 1

A 0.05 percent by volume solution of the leuco base dye Malachite Green (also known as para, para'-benzylidene-bis-(N,N-dimethylaniline)) is coated over a photothermographic layer on a resin covered paper support. The photothermographic layer comprises silver stearate in a silver bromoiodide-silver stearate dispersion containing 80 mg. of total silver per 929 square centimeters of support, 47 mg. of 2,6-dichloro-4-benzenesulfonamidophenol, 0.3 mg. of N-hydroxy-1,8-naphthalimide, 10 mg. of stearic acid, 20 mg. of poly(-vinyl butyral) binder and 3 mg. of lithium stearate per 929 square centimeters of support. The resin coating on the paper comprises polyethylene containing titanium dioxide. The leuco base dye solution easily penetrates the poly(vinyl butyral) containing layer. This provides a photothermographic element comprising the described leuco base dye.

After drying the photothermographic element, it is imagewise exposed to tungsten light with a high contrast negative original image. The imagewise exposure is for 2 seconds with a 60 watt tungsten light bulb at a distance of 15 inches. After imagewise exposure, the photothermographic element is heated by contacting the element with a heated metal block at 100° C. for 5 seconds.

A high contrast dye image is produced in the exposed areas of the photothermographic element. Also, a developed silver image is produced in the exposed areas. The dye image has a maximum reflection density to red light of 1.70. Some dye printup is observed in the background areas of the heated photothermographic element subsequent to exposure to room light.

The photothermographic layer is removed from the element by rinsing with alcohol to reveal a dye image in the polyethylene layer on the paper support.

Background areas of the image in the polyethylene show to tendency to printup and have a minimum density of 0.1.

EXAMPLE 2

The procedure described in Example 1 is repeated with the exception that the leuco base Crystal Violet (also known as 4,4',4''-methylidyne-tris)N,N-dimethylaniline) is employed in place of leuco base Malachite Green. A dye image results in the polyethylene layer of the paper support and in the exposed areas of the photothermographic element employing this procedure.

EXAMPLE 3

Leuco base Malachite Green is incorporated directly into a polyethylene-coated paper support, containing titaniumdioxide in the polyethylene layer, by coating a 0.05 percent alcohol solution of the leuco base Malachite Green onto the polyethylene layer followed by drying. The photothermographic composition comprises about 80 mg. of silver in the form of a silver bromoiodide-silver behenate dispersion (containing 6% iodide), 47 mg. of 2,6-dichloro-4-benzenesulfonamidophenol, 0.3mg. of N-hydroxy-1,8-naphthalimide, 23 mg. of behenic acid and 20 mg of poly(vinyl butyral) with 3 mg. of lithium stearate per 929 square centimeters of support. The resulting photothermographic element is imagewise exposed to tungsten light, as described in Example 1, and then heated by contacting the photothermographic element with a heated metal block at 125° C. for 2 seconds. A dye image is observed in the polyethylene layer of the paper support and in the exposed areas of the photothermographic element.

It is observed that the photothermographic element exhibits a photographic speed increase of about 4 times compared to an untreated control containing no leuco base dye in the polyethylene layer of the paper support.

The photothermographic layer is removed by rinsing the photothermographic element with alcohol after processing.

Some dye formation is observed in the background areas of the polyethylene layer containing the dye. The dye image resulting in the polyethylene layer has a minimum reflection density of 0.35 to red light.

Subsequent exposure to room light of the polyethylene containing dye image produces no further increase in minimum density.

The dye image in the polyethylene on the paper support has a maximum reflection density of approximately 0.95 to red light.

EXAMPLE 4

The procedure described in Example 3 is repeated with the exception that the leuco base Crystal Violet is employed in place of leuco base Malachite Green. Employing this procedure, a dye image is produced in the polyethylene layer of the paper support. The maximum reflection density of the dye image in the polyethylene is 1.23 to white light and exhibits a minimun reflection density of 0.20.

EXAMPLE 5

A photothermographic element is prepared by coating a photothermographic composition as in Example 3 on a paper support. The photothermographic element after drying does not contain a leuco base dye.

The photothermographic element is imagewise exposed to tungsten light as described in Example 1 and then pressed against a dry sheet of paper, i.e., a paper receiver, which was previously imbibed with 0.05 percent by volume solution of leuco Malachite Green in alcohol.

The resulting combination is heated by contacting the paper receiver side of the combination with a heated metal block at 100° C. for 5 seconds.

A dye image is formed in the photothermographic material as well as in the paper receiver.

EXAMPLE 6

The procedure described in Example 5 is repeated with the exception that leuco base Crystal Violet is employed in place of leuco base Malachite Green.

Employing this procedure, a dye image is produced in the paper receiver.

EXAMPLE 7

A photothermographic element is prepared as described in Example 1 containing leuco base Malachite Green. The photothermographic element is imagewise exposed to tungsten light through a high contrast netative. The imagewise exposure is for 2 seconds to a 60 watt tungsten light source at a distance of 15 inches. The exposed photothermographic element is pressed against a sheet of white paper and the combination is then overall heated by pressing the photothermographic element side of the combination against a heated metal block at 225° C. for 2 seconds.

A dye image is formed in the paper in areas corresponding to the exposed areas of the photothermographic element.

When the procedure is repeated with the exception that alcohol is applied to the paper receiver just prior to heating the combination, a higher density dye image is observed in the paper receiver.

The dye image initially observed in the paper has a maximum reflection density of 0.15 and a minimum reflection density of 0.04. When alcohol is applied to the paper receiver prior to transfer of the dye image, the resulting dye image in the paper receiver has a maximum reflection density of 0.30 and a minimum reflection density of 0.04.

EXAMPLE 8

A photothermographic element is prepared as described in Example 3. However, the leuco base dye is omitted. The resulting photothermographic element is imagewise exposed to a high contrast negative. The imagewise exposure is for 2 seconds with a 60 watt tungsten light source at a distance of 15 inches. The resulting exposed photothermographic element is heated by contacting the element with a heated metal block at 125° C. for 2 seconds. After removal of the emulsion layer with ethanol a brown-colored, low-density image is observed in the polyethylene layer on the paper support corresponding to the exposed areas of the photothermographic element.

A 0.05 percent by volume alcohol solution of leuco Malachite Green is coated on the resulting paper receiver containing the brown developed image. Within 15 to 30 seconds, a green dye image is visible in the polyethylene layer on the paper support.

The procedure is repeated except that the leuco base Malachite Green is applied to the side of the paper support opposite the polyethylene coating. A dye image is formed in the polyethylene coating in areas corresponding to the image areas in the polyethylene layer.

This illustrates that a dye image can be formed from a weak latent image in a photothermographic element according to the invention.

EXAMPLE 9

A 0.05 percent by volume alcohol solution of leuco base Crystal Violet is imbibed into the photothermographic element described in Example 5 comprising a polyethylene paper support. After drying, the resulting photothermographic element is imagewise exposed with a high contrast negative. The imagewise exposure is for 2 seconds with a 60 watt tungsten light source at a distance of 15 inches. The resulting exposed photothermographic element is pressed against a sheet of polyethylene-coated paper and the resulting combination is heated by contacting the combination with a heated metal block at 125° C. for 2 seconds. The polyethylene coated paper sheet is then separated from the photothermographic element. The photographic layer of the photothermographic element is removed from the support by stripping. A positive appearing dye image is visible in the polyethylene layer of the paper support. The dye image in the uncovered portion of the polyethylene layer (negative working) has a maximum reflection density of 0.20. The minimum reflection density of the dye image is 0.08.

EXAMPLE 10

This example illustrates a direct positive image forming process, i.e., a process in which the resulting image is a direct reproduction of the image to which the photothermographic element is exposed. The procedure set out in Example 9 is repeated except that the heating time of the combination is increased from 2 seconds to 6 seconds. The resulting paper support with the photographic layer removed exhibits a negative dye image which is a direct reproduction of the high contrast negative to which the element is exposed (positive working). The dye image in the uncovered polyethylene layer of the paper support (positive working) has a maximum reflection density of 0.30 and a minimum reflection density of 0.08.

EXAMPLE 11

A photothermographic element is prepared as described in Example 3. The photothermographic element is exposed imagewise to a high contrast negative original. The imagewise exposure is for 2 seconds with a 60 watt tungsten light source at a distance of 15 inches. The exposed photothermographic element is then heated by contacting it with a heated metal block at 125° C. for 2 seconds. A sheet of polyethylene coated paper containing a cationic mordant is then pressed against the exposed photothermographic element. The combination is then heated by contacting the combination with a heated metal block at 125° C. for 2 seconds. A dye image is transferred from the photothermographic element to the described image receiver.

EXAMPLE 12

A paper support is coated with a poly(vinyl butyral) composition containing leuco base Malachite Green. The resulting layer contains 72 mg of polyvinyl butyral) and 1.7 mg. of leuco base Malachite Green per 929 square centimeters of support. The resulting layer is overcoated with a silver behenate-silver bromoiodide photothermographic composition as described in Example 3. The resulting overcoat contains 80 mgs. of silver per 929 square centimeters of support. The resulting photothermographic element is imagewise exposed with a step tablet. The imagewise exposure is for 2 seconds with a 60 watt tungsten light source at a distance of 15 inches. The exposed photothermographic element is then heated by contacting it with a heated metal block at 125° C. for 2 seconds.

A high contrast dye image results in the photothermographic element. The dye image has a maximum reflection density of 1.81 to red light. Upon exposure of the photothermographic element to room light, some dye printup occurs in the background areas.

Removal of the photographic layer with alcohol reveals the presence of a dye image in the polyethylene layer on the paper support. The background areas of this dye image show no tendency to printup. The minimum reflection density of this image is 0.1.

EXAMPLE 13

The procedure described in Example 12 is repeated with the exception that the poly(vinyl butyral) layer containing leuco base Malachite Green is coated over the layer containing the silver halide rather than under the silver halide containing layer. The resulting photothermographic element is imagewise exposed to a high contrast negative original. The imagewise exposure is for 2 seconds with a 60 watt tungsten light source at a distance of 15 inches. The exposed photothermographic element is heated by contacting it with a heated metal block at 125° C. for 2 seconds. A dye image is produced with a silver image in the photothermographic element. The dye image has a maximum reflection density of 1.53 to red light.

EXAMPLE 14

The procedure described in Example 13 is repeated with the exception that the photothermographic coating is applied to a poly(ethylene terephthalate) film support. The photothermographic element is imagewise exposed with a step tablet. The imagewise exposure is for 2 seconds to a 60 watt tungsten light source at a distance of 15 inches. The exposed photothermographic element is then heated by contacting it with a heated metal block at 125° C. for 2 seconds. The image in the resulting photothermographic element has a maximum transmission density of 1.56 and a minimum transmission density of 0.10.

A similar photothermographic element without the described leuco base dye and without the poly(vinyl butyral) layer provides a developed image having a maximum reflection density of 0.34 and a minimum reflection density of 0.04. The two-layer photothermographic element as described exhibits photographic speed which is about 0.75 log E faster than the single layer photographic element without the leuco base dye.

The polyester film support is transparent permitting viewing of the dye image through the support.

EXAMPLE 15

The procedure described in Example 13 is repeated with the exception that 4-benzenesulfonamidophenol is employed in place of 2,6-dichloro-4-benzenesulfonamidophenol as the organic reducing agent in the described photothermographic element. Upon imagewise exposure and overall heating of the resulting photothermographic element, a dye image having about the same hue as the dye image produced in Example 13 is observed. A developed silver image is also produced in the exposed areas of the photothermographic element.

EXAMPLE 16

An image receiver is prepared by coating polyethylene containing titanium dioxide on a polyester film support. The polyethylene layer contains 1,955 mg. of polyethylene and 340 mg. of titanium dioxide per 929 square centimeters of support. The resulting layer is swabbed with a 0.05 percent by volume alcohol solution of leuco base Malachite Green and allowed to dry.

A photothermographic element is prepared as described in Example 13 on a polyethylene terephthalate film support without the leuco base dye described in Example 13. The photothermographic element is imagewise exposed to tungsten light. The imagewise exposure is for 2 secons with a 60 watt tungsten light source at a distance of 15 inches. The resulting exposed photothermographic element is then pressed against the described image receiver and the resulting combination is overall heated by contacting it with a heated metal block at 125° C. for 2 seconds. The image receiver is then separated from the photothermographic element. A green dye image is observed in the image receiver. This image is also visible through the polyethylene terephthalate film support indicating the formation of dye throughout the entire thickness of the polyethylene layer.

EXAMPLE 17

The two-layer photothermographic element of Example 12 is prepared and then imagewise exposed to a high contrast negative original. The imagewise exposure is for 2 seconds with a 60 watt tungsten light source at a distance of 15 inches. The photothermographic element is then pressed against a polyethylene containing image receiver as described in Example 16 and the resulting combination is heated by contacting it with a heated metal block at 125° C. for 2 seconds under room light conditions. A direct positive dye image is formed in the receiving layer. This dye image is also visible from the support side of the image receiver. The background portions of the positive dye image appear to be stable to printup. The image in the image receiver has a maximum density of 0.40 and a minimum density of 0.07.

EXAMPLE 18

A photothermographic element is prepared as described in Example 12 except that the poly(vinyl butyral) layer containing leuco base Malachite Green is coated over the photothermographic layer rather than under it. The resulting photothermographic element is exposed imagewise to a high contrast negative original. The imagewise exposure is for 2 seconds with a 60 watt tungsten light source at a distance of 15 inches. The exposed photothermographic element is heated by contacting it with a heated metal block at 125° C. for 2 seconds. The heating is carried out in the dark. After heating, room lights are turned on (100 foot candles) and the photothermographic element is then again heated by contacting it with a heated metal block at 125° C. for 2 seconds in the room light. A direct reproduction of the original image is observed in the photothermographic element. Areas in which the original silver image was formed faded during the second heating step.

The developed dye image has a maximum density of 1.00 and a minimum density of 0.40 following the second heating step.

EXAMPLE 19

The procedure described in Example 13 is repeated with the exception that 2,5-dichlorohydroquinone is employed in place of 2,6-dichloro-4-benzenesulfonamidophenol as the organic reducing agent in the photothermographic element. Upon imagewise exposure and heating of the photothermographic element as described in Example 13, a dye image along with a silver image is produced in the photothermographic element. The dye image has a maximum density of 1.00 and a minimum density of 0.40.

EXAMPLE 20

A photothermographic element is prepared using a photothermographic composition as described in Example 3 on a poly(ethylene terephthalate) film support. The photothermographic element, however, contains no leuco base dye. The photothermographic element is imagewise exposed to a 60-watt tungsten light source for 2 seconds at a distance of 15 inches. The exposed photothermographic element is then heated by contacting it with a heated metal block at 125° C. for 2 seconds.

An image receiver is prepared by coating a poly(ethylene terephthalate) film support with a coating containing 72 milligrams of poly(vinyl butyral) and 1.7 milligrams of leuco base Malachite Green per 929 square centimeters of support. The image receiver is pressed against the processed photothermographic element and the combination is then heated by contacting it with a heated metal block at 125° C. for 2 seconds. The image receiver is then separated from the photothermographic element. A green dye image is observed in the image receiver corresponding to the negative silver image in the photothermographic element. A green dye image is also observed in the photothermographic element. The developed dye image in the image receiver has a maximum density of 1.50 and a minimum density of 0.60.

EXAMPLE 21

A two layer photothermographic element is prepared as described in Example 13. The support employed for this photothermographic element, however, is a poly(ethylene terephthalate) film support containing a matte coating. This matte coated poly(ethylene terephthalate) support is commercially available and can be written upon with pencil. The resulting photothermographic material is imagewise exposed to tungsten light from a 60 watt tungsten light source for 2 seconds at a distance of 15 inches. The photothermographic element after exposure is then heated by contacting it with a heated metal block at 125° C. for 2 seconds. A dye image is developed with a silver image in the exposed areas of the photothermographic element. The developed image has a maximum density of 0.8.

Removal of the photothermographic layer by swabbing with a cotton pad containing alcohol reveals the presence of a dye image mordanted in the matte layer of the poly(ethylene terephthalate) film support. The background areas of the developed dye image show no tendency to printup. The minimum density of the dye image is 0.14 and the surface of the developed image can be written upon with pencil.

EXAMPLE 22

Various tests can be employed for determining useful leuco base dyes according to the invention. One such test is as follows:

The leuco base dye to be tested is dissolved in an organic solvent to provide a 0.1 percent by weight solution of the dye in the solvent.

An equal volume of oxidized organic reducing agent, such as oxidized 4-benzenesulfonamidophenol, is added to the leuco base dye solution. The oxidized reducing agent is added as a 0.1 percent by weight solution of the oxidized reducing agent in alcohol. Dye formation occurs if the lueco base dye is oxidized by the oxidized organic reducing agent.

If dye formation does not take place at room temperature, the composition is heated to about 66° C.

If dye formation does not occur at 66° C., a few drops of the mixture are spotted on a piece of white blotter paper and the sample is then heated after drying to 200° C. by contacting it with a heated metal block at 200° C. If dye formation occurs, the lueco base dye is considered to be useful.

Employing this procedure, the leuco base dyes listed in following Table I provide the noted dye formation.

Table I

| Leuco Base | Dye Formation | Dye Color |
|---|---|---|
| tris(p-N,N-dipropylaminophenyl) methane | yes | violet |
| tris(p-N,N-diethylaminophenyl) methane | yes | violet |
| tris(p-N,N-dimethylaminophenyl) methane | yes | violet |
| bis(p-N,N-diethylaminophenyl)-p-N,N-diethylamino-o-toluidine methane | yes | blue-violet |
| bis(p-N,N-diethylamino-o-ethoxyphenyl)-p-N,N-diethylaminophenyl methane | yes | blue-violet |
| bis(p-N,N-dimethylamino-o-toluidine)-p-N,N-dimethylaminophenyl methane | yes | blue |

Table I-continued

| Leuco Base | Dye Formation | Dye Color |
|---|---|---|
| tris(p-N,N-diethylamino-2-chlorophenyl) methane | no | |
| 4,4'-bis(diethylamino)-2,2'-dimethyltriphenyl methane | yes (200° C) | green |

EXAMPLE 23

A composition is prepared by mixing silver tri-fluoroacetate with 3-carboxymethyl-4-methyl-4-thiazoline-2-thione and silver iodide in gelatin. The silver salt of 3-carboxymethyl-4-methyl-4-thiazoline-2-thione is formed in the composition by reaction of the silver ions with the described thione compound. The resulting composition is coated on a polyethylene coated paper support at 70 mg. of silver trifluoroacetate, 112 mg. of 3-carboxymethyl-4-methyl-4-thiazoline-2-thione and 7 mg. of silver iodide per 929 square centimeters of support. The resulting coating is then overcoated with a composition containing 2,5-dichloro-hydroquinone and N-hydroxy-1,8-naphthalimide at 12 mg. of 2,5-dichlorohydroquinone and 12 mg. of N-hydroxy-1,8-naphthalimide per 929 square centimeters of support. The resulting photo-thermographic material is imagewise exposed with a high-contrast negative original. The imagewise exposure is for 15 seconds with a 200 watt tungsten light source at a distance of 15 inches. The exposed photothermographic element is then overall heated by contacting it with a heated metal block at 165° C. for 5 seconds. A brown image is produced in the exposed areas of the photothermographic element. The developed image has a maximum density of 0.05 and a minimum density of 0.03.

The procedure is repeated with the exception that leuco base Crystal Violet is also incorporated in the photothermographic coating at the rate of 2.5 mg. of leuco base Crystal Violet per 929 square centimeters of support. Upon imagewise exposure and overall heating of the resulting photothermographic element, a violet dye image is developed in the exposed areas of the photothermographic element. The developed dye image has a maximum density of 0.23 and a minimum density of 0.10.

EXAMPLE 24

A photothermographic element was prepared as follows: A layer was prepared on polyethylene-$TiO_2$ coated paper. This layer contained 31.3 mg/dm$^2$ of silver dehenate, 23.8 mg/dm$^2$ of behenic acid, and 10.8 mg/dm$^2$ of poly(vinyl butyral). This material was flow coated with the following formula:

| | |
|---|---|
| 4.2% by weight silver bromoiodide-poly(vinyl butyral) emulsion prepared with 3.8% by weight poly(vinyl butyral) in 1:1 parts by volume acetone-toluene | 5 ml |
| 0.25% by volume leuco base Malachite Green in methyl ethyl ketone | 5 ml |
| 0.20% by volume 2,6-dichloro-4-benzene-sulfonamidophenol in ethanol | 5 ml |

After drying, the photothermographic element was imagewise exposed to a high contrast negative original for 15 seconds with a 60-watt tungsten light bulb at a distance of 15 inches. The latent image in the exposed photothermographic element was then developed by heating the element by contacting it with a curved heating block at 125° C. for 5 seconds. A dye image with a silver image was provided in the exposed areas of the element. The image had a maximum reflection density to red light of 0.60 and a minimum reflection density to red light of 0.018.

Removal with ethanol of the above layers of the element revealed a dye image in the polyethylene layer—$TiO_2$ layer below. The background areas showed no tendency to print-up on exposure to light. The dye image has a maximum reflection density of 0.30 and a minimum reflection density of 0.03.

If desired, an image in the described photothermographic elements of the invention can be produced by imagewise heating the photothermographic element rather than imagewise exposure of the photothermographic element to light followed by heating the element. However, significantly higher heating temperature is required to provide a developed image by imagewise heating.

The invention has been described in detail with particular reference to preferred embodiments thereof, but it will be understood that variations and modifications can be effected within the spirit and scope of the invention.

What is claimed is:

1. A photothermographic element for producing a dye image comprising a support having coated thereon a. photographic silver halide in association with b. an oxidation-reduction image-forming combination comprising i. a non-light sensitive, organic, silver salt oxidizing agent, with ii. an organic reducing agent, c. a polymeric binder, and d. a leuco base dye represented by the formula:

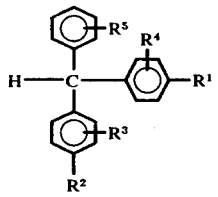

wherein $R_1$ and $R_2$ are each

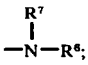

$R^4$ and $R^5$ are each amino, hydrogen, alkyl containing 1 to 6 carbon atoms, or alkoxy containing 1 to 3 carbon atoms; and $R^6$ and $R^7$ are each alkyl containing 1 to 5 carbon atoms or aryl containing 6 to 12 carbon atoms; which is oxidizable to form a dye image.

2. A photothermographic element as in claim 1 wherein said leuco base dye is Malachite Green.

3. A photothermographic element as in claim 1 wherein said leuco base dye is Crystal Violet.

4. A photothermographic element as in claim 1 wherein said leuco base dye is Pararosaniline.

5. A photothermographic element as in claim 1 comprising about 0.002 mole to about 0.010 mole of said leuco base dye per mole of total silver in said layer.

6. A photothermographic element as in claim 1 also comprising a development modifier.

7. A photothermographic element for producing a dye image comprising a support having coated thereon
a. photographic silver halide in association with
b. an oxidation-reduction image-forming combination comprising
i. silver behenate, with
ii. a sulfonamidophenol reducing agent,
c. a poly(vinyl butyral) binder, and
d. about 0.002 mole to about 0.010 mole of a leuco base dye represented by the formula:

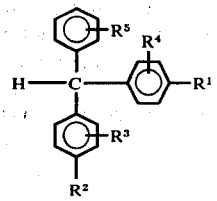

wherein $R^1$ and $R^2$ are each

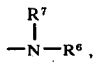

$R^3$; $R_4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;
per mole of total silver in said layer, said leuco base dye being oxidizable to form a dye image.

8. A photothermographic element as in claim 7 also comprising a development modified which is a compound selected from the group consisting of succinimide, N-hydroxy-1,8-naphthalimide and 1-(2H)-phthalazinone.

9. A photothermographic element for producing a dye image comprising a support having coated thereon
a. photographic silver halide in association with
b. an organic reducing agent,
c. a silver salt oxidizing agent comprising a silver salt of a compound represented by the formula;

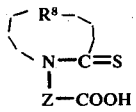

wherein $R^8$ represents a group containing the atoms which complete a 5-member heterocyclic nucleus with the atoms modified in said formula, and Z is alkylene containing 1 to 14 carbon atoms,
d. a polymeric binder,
e. a development modifier, and
f. a leuco base dye represented by the formula:

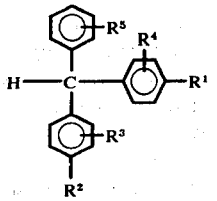

wherein $R^1$ and $R^2$ are each

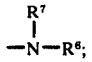

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;
which is oxidizable to form a dye image.

10. A photothermographic element for producing a dye image comprising a support having coated thereon
a. photographic silver halide in association with
b. an organic reducing agent which is a hydroquinone silver halide developing agent,
c. a silver salt of 3-carboxymethyl-4-methyl-4-thiazoline-2-thione,
d. a polymeric binder,
e. a development modifier which is a compound selected from the group consisting of succinimide, N-hydroxy-1,8-naphthalimide and 1-(2H)-phthalazinone and
f. a leuco base dye represented by the formula:

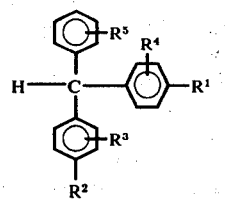

wherein $R^1$ and $R^2$ are each

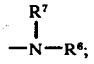

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;
which is oxidizable to form a dye image.

11. A diffusion transfer, photothermographic element for producing a dye image comprising a support having thereon, in sequence,
I.. a layer comprising
a. photographic silver halide in association with
b. an oxidation-reduction image-forming combination comprising
i. a non-light sensitive, organic, silver salt oxidizing agent, with
ii. an organic reducing agent,
c. a development modifier,
d. a polymeric binder for said layer (I), and
e. a leuco base dye represented by the formula:

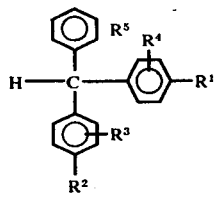

wherein $R^1$ and $R^2$ are each

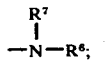

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;

which is oxidizable to form a dye image and

II. an image receiving layer.

12. A diffusion transfer, photothermographic element as in claim 11 wherein said image receiving layer (II) comprises a mordant for said dye image.

13. A diffusion transfer, photothermographic element for producing a dye image comprising a support having thereon, in sequence, I. a layer comprising a. photographic silver halide in association with b. an oxidation-reduction image-forming combination comprising i. a non-light sensitive, organic, silver salt oxidizing agent, with ii. an organic reducing agent, c. a development modifier, d. a polymeric binder for said layer (I), e. a leuco base dye represented by the formula:

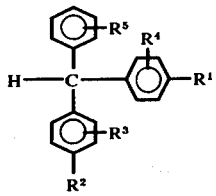

wherein $R^1$ and $R^2$ are each

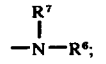

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;

which is oxidizable to form a dye image,

II. an opacifying layer, and

III. an image receiving layer.

14. An integral diffusion transfer, photothermographic element for producing a dye image comprising respectively a transparent support having thereon, in sequence, I. a layer comprising a. photographic silver halide in association with b. an oxidation-reduction image-forming combination comprising i. silver behenate, with ii. a sulfonamidophenol reducing agent, c. a poly(vinyl butyral) binder for said layer (I), and d. about 0.002 mole to about 0.010 mole of a leuco base dye per mole of total silver in said element, said leuco base dye being selected from the group consisting of Malachite Green, Crystal Violet and Pararosaniline, and II. an opacifying layer comprising titanium dioxide and III. an image receiving layer comprising a dye mordant for said dye image.

15. An integral diffusion transfer, photothermographic element as in claim 14 also comprising a development modifier which is a compound selected from the group consisting of succinimide, N-hydroxy-1,8-napthalimide and 1-(2H)-phthalazinone.

16. A photothermographic composition comprising a. photographic silver halide in association with b. an oxidation-reduction image-forming combination comprising i. a non-light sensitive, organic, silver salt oxidizing agent, with ii. an organic reducing agent, c. a polymeric binder for said composition, and d. a leuco base dye represented by the formula:

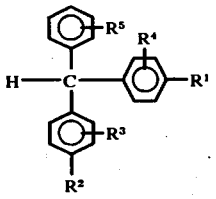

wherein $R^1$ and $R^2$ are each

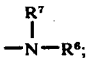

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;

which is oxidizable to form a dye image.

17. A photothermographic composition as in claim 16 also comprising a development modifier.

18. A photothermographic composition comprising a. photographic silver halide in association with b. an oxidation-reduction image-forming combination comprising i. silver behenate, with ii. a sulfonamidophenol reducing agent, c. a poly(vinyl butyral) binder for said composition, and d. Leuco-base Malachite Green.

19. A photothermographic composition comprising a. photographic silver halide in association with b. an oxidation-reduction image-forming combination comprising i. silver behenate, with ii. a sulfonamidophenol reducing agent, c. a poly(vinyl butyral) binder for said composition, and
d. Leuco-base Crystal Violet.

20. A photothermographic composition comprising
a. photographic silver halide in association with
b. an oxidation-reduction image-forming combination comprising
i. silver behenate, with
ii. a sulfonamidophenol reducing agent,
c. a poly(vinyl butyral) binder for said composition and
d. Leuco-base Pararosaniline.

21. A photothermographic composition comprising
a. photographic silver halide in association with
b. an organic reducing agent,
c. a silver salt oxidizing agent comprising a silver salt of a compound represented by the formula:

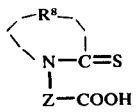

wherein $R^8$ represents atoms necessary to complete a 5-member heterocyclic nucleus, and Z is alkylene containing 1 to 14 carbon atoms,
d. a polymeric binder for said composition,
e. a development modifier, and
f. a leuco base dye represented by the formula:

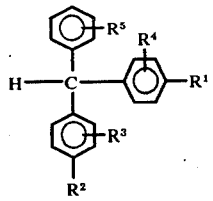

wherein $R^1$ and $R^2$ are each

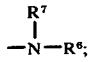

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;

which is oxidizable to form a dye image.

22. A photothermographic composition comprising
a. photographic silver halide in association with
b. a hydroquinone silver halide developing agent,
c. a silver salt of 3-carboxymethyl-4-methyl-4-thiazoline-2-thione,
d. a polymeric binder for said composition,
e. a development modifier which is a compound selected from the group consisting of succinimide, N-hydroxy-1,8-naphthalimide and 1-(2H)-phthalazinone, and
f. a leuco base dye selected from the group consisting of Malachite Green, Crystal Violet and Pararosaniline.

23. A process of developing an image in an exposed, photothermographic element comprising a support having coated thereon
a. photographic silver halide in association with
b. an oxidation-reduction image-forming combination comprising
i. a non-light sensitive, organic, silver salt oxidizing agent, with
ii. an organic reducing agent,
c. a polymeric binder, and
d. a leuco base dye represented by the formula:

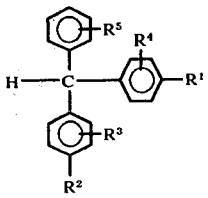

wherein $R^1$ and $R^2$ are each

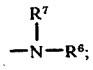

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms, which is oxidizable to form a dye image, comprising heating said element to a temperature within the range of about 80° to about 250° C.

24. A process as in claim 23 wherein said photothermographic element also comprises a development modifier.

25. A process as in claim 23 wherein said element is heated to a temperature within the range of about 80° C. to about 250° C. for about 0.5 to about 60 seconds.

26. A process of developing an image in an exposed photothermographic element comprising a support having coated thereon
a. photographic silver halide in association with
b. an oxidation-reduction image-forming combination comprising
i. silver behenate, with
ii. a sulfonamidophenol reducing agent,
c. a poly(vinyl butyral) binder,
d. about 0.002 mole to about 0.010 mole of a leuco base dye per mole of total silver in said element, said leuco base dye being selected from the group consisting of Malachite Green, Crystal Violet and Pararosaniline, comprising heating said element to a temperature within the range of about 100° C. to about 175° C. for about 0.5 to about 60 seconds.

27. A process as in claim 26 wherein said photothermographic element also comprises a development modifier which is a compound selected from the group consisting of succinimide, N-hydroxy-1,8-naphthalimide and 1-(2H)-phthalazinone.

28. A process of developing an image in an exposed, diffusion transfer, photothermographic element comprising a support having thereon, in sequence,
I. a layer comprising
a. photographic silver halide in association with
b. an oxidation-reduction image-forming combination comprising
i. a non-light sensitive, organic, silver salt oxidizing agent, with ii. an organic reducing agent,
c. a development modifier,
d. a polymeric binder for said layer (I), and
e. a leuco base dye represented by the formula:

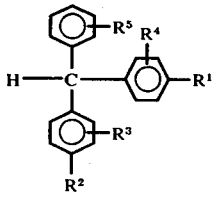

wherein $R^1$ and $R^2$ are each

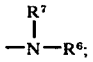

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;

which is oxidizable to form a dye image and

II. an image receiving layer, comprising heating said layers to a temperature within the range of about 80° C to about 250° C.

29. A process as in claim 28 also comprising separating said receiving layer (II) from said element after heating said layers.

30. A process of developing an image in an exposed, diffusion transfer photothermographic element comprising a support having thereon, is sequence, (I) a layer comprising a. photographic silver halide in association with
b. an oxidation-reduction image-forming combination comprising
i. silver behenate, with
ii. a sulfonamidophenol reducing agent,
c. a poly(vinyl butyral) binder for said layer (I),
d. about 0.002 mole to about 0.010 mole of a leuco base dye per mole of total silver in said element, said leuco base dye being selected from the group consisting of Malachite Green, Crystal Violet and Pararosaniline, and (II) an image receiving layer comprising a mordant for a dye image from said layer (I), comprising heating said layers to a temperature within the range of about 80° to about 250° C.

31. A process as in claim 30 wherein said photothermographic element also comprises a development modifier which is a compound selected from the group consisting of succinimide, N-hydroxy-1,8-naphthalimide and 1-(2H)-phthalazinone.

32. A process of developing an image in an exposed, photothermographic element comprising a support having coated thereon a. photographic silver halide in association with
b. an organic reducing agent,
c. a silver salt of the compound represented by the formula:

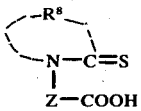

wherein $R^8$ represents atoms necessary to complete a 5-member heterocyclic nucleus, and Z is alkylene containing 1 to 14 carbon atoms, d. a polymeric binder,
e. a development modifier, and
f. a leuco base dye represented by the formula:

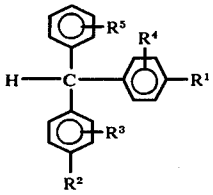

wherein $R^1$ and $R^2$ are each

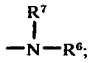

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;

which is oxidizable to form a dye image, comprising heating said element to a temperature within the range of about 100° to about 180° C.

33. A process as in claim 22 comprising heating said element to a temperature within the range of about 100° C. to about 180° for about 0.5 to about 60 seconds.

34. A process of providing a direct positive, dye image in a photothermographic unit comprising, in sequence, a support having coated thereon A. a dye-image receiver layer,
B. a layer comprising a leuco base dye represented by the formula:

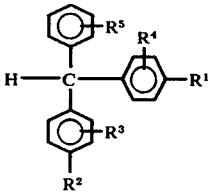

wherein $R^1$ and $R^2$ are each

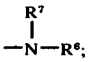

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;

which is oxidizable to form a dye image, and

C. a photothermographic layer containing a latent image and comprising
a. photographic silver halide in association with
b. an oxidation-reduction image-forming combination comprising i. a non-light sensitive, organic, siler salt oxidizing agent, with ii. an organic reducing agent, c. a development modifier, and d. a polymeric binder for said layer (C), comprising exposing to light and heating said photothermographic unit to provide a positive dye image in said image receiver layer, and thereafter separating said layers (B) and (C) from said layer (A).

35. A process of providing a direct positive, dye image in a photothermographic unit comprising, in sequence, a support having coated thereon A. an image receiver layer, B. a photothermographic layer containing a latent image and comprising a. photographic silver halide in association with b. an oxidation-reduction image-forming combination comprising i. a non-light sensitive, organic, silver salt oxidizing agent, with ii. an organic reducing agent, c. a development modifier, and d. a polymeric binder for said layer (B), and C. a layer comprising a leuco base dye represented by the formula:

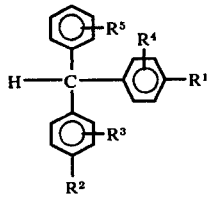

wherein $R^1$ and $R^2$ are each

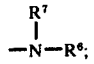

$R^3$, $R^4$ and $R^5$ are each amino, hydrogen, alkyl containing 1 to 6 carbon atoms or alkoxy containing 1 to 3 carbon atoms; and $R^6$ and $R^7$ are each alkyl containing 1 to 5 carbon atoms or aryl containing 6 to 12 carbon atoms;

which is oxidizable to form a dye image, comprising 1. heating said photothermographic unit to provide a dye image in said layer (B); thereafter 2. exposing to light and heating said photothermographic unit to provide a positive dye image in said layer (A).

36. A process as in claim 35 also comprising, after said heating to provide a direct positive, dye image in said layer (A), separating said layers (B) and (C) from layer (A).

* * * * *

UNITED STATES PATENT AND TRADEMARK OFFICE

CERTIFICATE OF CORRECTION

PATENT NO. : 4,022,617

DATED : May 10, 1977

INVENTOR(S) : Hugh G. McGuckin

It is certified that error appears in the above-identified patent and that said Letters Patent are hereby corrected as shown below:

Column 2, line 35, "comprisess" should read ---comprises---.

Column 4, line 45, "proply" should read ---propyl---.

Column 5, line 30, "chlorobromoidide" should read ---chlorobromoiodide---. Line 36, "photograhic" should read ---photographic---.

Column 6, line 34, "photothermograhic" should read ---photothermographic---. Line 62, "palimitate" should read ---palmitate---. Line 63, after "acids", ---. Silver salts which are not silver salts of long-chain fatty acids--- should be inserted.

Column 7, line 21, that part of the formula reading "benzoathiazoline" should read ---benzothiazoline---. Line 28, "1,3-bis(2-carboxyethyl)imidazoline-2-thione" should be on a separate line following the previous formula. Lines 56-57, that part of the formula reading "di(2e-thoxyethyl)" should read ---di(2-ethoxyethyl)---.

Column 8, line 24, that part of the formula reading "1,8-napthalimide" should read ---1,8-naphthalimide---. Line 59, "methacryltes" should read ---methacrylates---. Line 65, "celluslose" should read ---cellulose---.

UNITED STATES PATENT AND TRADEMARK OFFICE

CERTIFICATE OF CORRECTION

PATENT NO. : 4,022,617

DATED : May 10, 1977

INVENTOR(S) : Hugh G. McGuckin

It is certified that error appears in the above-identified patent and that said Letters Patent are hereby corrected as shown below:

Column 9, line 11, "described" should read ---described,---. Line 19, "0.16" should read ---0.016---. Line 25, "photothermograhic" should read ---photothermographic---. Line 27, "oxidation-reducing" should read --- oxidation-reduction ---. Line 35, that part of the compound name reading "hydroxyl" should read ---hydroxy---. Line 41, "oxidixing" should read ---oxidizing---. Lines 50-51, "emodiment" should read ---embodiment---.

Column 10, line 24, "a" should read ---as---. Line 26, "1962" should read ---1962;---. Line 42, "brightenig" should read ---brightening---.

Column 11, line 6, after "April 11, 1950", ---; U.S. Patent 2,493,748--- should be inserted. Line 11, "sytryls" should read ---styryls---. Line 31, "phenyl" should read ---phenyl,---.

Column 12, line 30, "compoents" should read ---components---. Line 65, "combustion" should read ---combination---.

Column 13, line 12, after "$R^8$", ---and--- should be inserted.

UNITED STATES PATENT AND TRADEMARK OFFICE

CERTIFICATE OF CORRECTION

PATENT NO. : 4,022,617
DATED : May 10, 1977
INVENTOR(S) : Hugh G. McGuckin

It is certified that error appears in the above-identified patent and that said Letters Patent are hereby corrected as shown below:

Column 15, line 6, "heating a" should read ---having a---.

Column 16, line 16, "show to" should read ---show no---.

Column 17, lines 40-41, "netative" should read ---negative---.

Column 19, line 15, "polyvinyl" should read ---poly(vinyl---.

Column 20, line 39, "secons" should read ---seconds---.

Column 23, line 50, "dehenate" should read ---behenate---.

Column 24, line 13, "0.018" should read ---0.18---.

<u>In the Claims</u>:

Column 24, line 60, before "$R^4$", ---$R^3$,--- should be inserted.

Column 25, line 31, "$R_4$" should read ---$R^4$---.

UNITED STATES PATENT AND TRADEMARK OFFICE

CERTIFICATE OF CORRECTION

PATENT NO. : 4,022,617
DATED : May 10, 1977
INVENTOR(S) : Hugh G. McGuckin

It is certified that error appears in the above-identified patent and that said Letters Patent are hereby corrected as shown below:

Column 25, line 38, "modified" should read ---modifier---.

Column 30, line 32, "wherin" should read ---wherein---.

Column 32, line 32, "22" should read ---32---.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*